US005544687A

United States Patent [19]

Barnes et al.

[11] Patent Number: 5,544,687

[45] Date of Patent: Aug. 13, 1996

[54] GAS GENERANT COMPOSITIONS USING DICYANAMIDE SALTS AS FUEL

[75] Inventors: Michael W. Barnes; Thomas M. Deppert, both of Brigham City; Robert D. Taylor, Hyrum, all of Utah

[73] Assignee: Morton International, Inc., Chicago, Ill.

[21] Appl. No.: 182,478

[22] Filed: Jan. 14, 1994

Related U.S. Application Data

[63] Continuation-in-part of Ser. No. 165,771, Dec. 10, 1993.

[51] Int. Cl.[6] ..... C06B 29/08

[52] U.S. Cl. ..... 149/83; 149/85; 149/61

[58] Field of Search ..... 149/21, 2, 61, 149/83, 85

[56] References Cited

U.S. PATENT DOCUMENTS

| | | | |
|---|---|---|---|
| 4,078,954 | 3/1978 | Bernardy | 149/19.8 |
| 4,128,443 | 12/1978 | Pawlak | 149/71 |
| 4,203,787 | 7/1980 | Kirchoff et al. | 149/35 |
| 4,377,426 | 3/1983 | Levenson | 149/109.6 |
| 4,386,979 | 7/1983 | Jackson et al. | 149/21 |
| 5,143,567 | 9/1992 | Taylor et al. | 149/35 |
| 5,345,873 | 9/1994 | Lauritzen et al. | 102/290 |

FOREIGN PATENT DOCUMENTS 0519485 12/1992 European Pat. Off. .

*Primary Examiner*—Donald P. Walsh
*Assistant Examiner*—Anthony R. Chi
*Attorney, Agent, or Firm*—Wayne E. Nacker; Gerald K. White

[57] ABSTRACT

A gas generant composition includes a fuel, at least 25 wt % of which is an alkali, alkaline earth, and/or transition metal salt of dicyanamide and an oxidizer which is an ammonium, alkali metal and/or alkaline earth metal salt of a chlorate, perchlorate or nitrate.

14 Claims, No Drawings

GAS GENERANT COMPOSITIONS USING DICYANAMIDE SALTS AS FUEL

This is a continuation-in-part of U.S. application Ser. No. 08/165,771 filed on 10 Dec. 1993.

The present invention is directed to gas generant compositions suitable for automotive air bag restraint systems, and more particularly to gas generant systems using dicyanamide salts as fuel.

BACKGROUND OF THE INVENTION

Most automotive air bag restraint systems, presently in use, use gas generant compositions in which sodium azide is the principal fuel. Because of disadvantages with sodium azide, particularly instability in the presence of metallic impurities and toxicity, which presents a disposal problem for unfired gas generators, there is a desire to develop non-azide gas generant systems and a number of non-azide formulations have been proposed, e.g., U.S. Pat. Nos. 4,369,079 and 5,015,309, the teachings of which are incorporated herein by reference. However, to date, non-azide gas generants have not made significant commercial inroads.

Materials that have been previously proposed for non-azide gas-generants include salts of bitetrazole, aminotetrazole, nitrotriazolone, triazolone, salts of nitrobarbituric acid, salts of nitroorotic acid, nitrouracil, salts of guanidine, and salts of amino-substituted guanidine, such as amino guanidine and triamino guanidine. Disadvantages of these materials include not being commercially available or not being available at a reasonable price and containing hydrogen in their chemical structure. It is advantageous to have fuels that contain little or preferably no hydrogen in their chemical structure. Upon combustion, fuels that contain hydrogen produce water vapor. Water vapor could be disadvantageous to bag performance at cold temperatures due to condensation. Heat capacity of the output gases is also increased with increased water content and potentially results in burns to the vehicle occupant upon inflation of the bag.

U.S. Pat. No. 4,386,979 to Jackson Jr. et al., the teachings of which are incorporated herein by reference, teaches the use of cyanamide, dicyanodiamide (the dimerization product of cyanamide), and salts thereof as fuels in gas generant compositions. While some of the salts of cyanamide and dicyanodiamide are commercially available at a reasonable price and as salts of cyanamide contain no hydrogen, they have the disadvantage of not producing as great a quantity of gas upon combustion as would be desired. Further, they are not produced commercially in the purity that is required. The highest purity of commercial calcium cyanamide is 86 wt %, and the balance 14 wt % CaO renders the material unsuitable as a fuel. Dicyanodiamide has the disadvantage of a high hydrogen content.

SUMMARY OF THE INVENTION

A gas generant composition uses as at least a portion of the fuel component a compound which is an alkali or alkaline earth, or transition metal salt of dicyanamide or mixtures of alkali alkaline earth and/or transition metal salts. The gas generant composition further contains an internal oxidizer.

DETAILED DESCRIPTION OF CERTAIN PREFERRED EMBODIMENTS

The fuel, comprises between about 10 and about 60 wt % of the gas generant composition. At least about 25 wt %, up to 100% of the fuel comprises a fuel selected from alkali, alkaline earth, and/or transition metal salts of dicyanamide. From an availability standpoint, sodium dicyanamide is currently preferred. However, if calcium dicyanamide were more readily available, it would be preferred to sodium dicyanamide because it produces a readily filterable, non-reactive slag. Of transition metal dicyanamides, divalent transition metal dicyanamides are preferred, particularly cupric dicyanamide and zinc dicanamide. The remainder of the fuel may be an azide or non-azide fuel, added to adjust burn temperature and gas output. Preferably, this other fuel is a non-azide fuel, such as those discussed above. Suitable cations may be lithium, potassium, sodium, magnesium, calcium, strontium, cerium and barium. In addition to these fuels containing no hydrogen, they are relatively non-toxic, and when formulated with an appropriate oxidizer, produce a non-toxic gas mixture upon ignition to inflate an automobile crash bag.

Transition metal dicyanamides have certain advantages over alkali/alkaline earth dicyanamide compositions.

For instance, cupric dicyanamide can be oxidized with an oxidizer such as a metal nitrate, e.g. strontium nitrate, to produce carbon dioxide, nitrogen and copper metal. When an alkali/alkaline earth dicyanamide, e.g. sodium dicyanamide, is combusted with an oxidizer such as strontium nitrate, the predicted products are carbon dioxide, nitrogen and a metal carbonate. The net result is higher gas yield from cupric dicyanamide, moles per 100 grams of generant. For instance, thermodynamic calculations performed by the Naval Weapons Center Propellant Evaluation Program (PEP) show that a stoichiometrically balanced mixture of strontium nitrate (68.1%) and sodium dicyanamide (31.9%) and strontium nitrate (36.6%) produce 1.61 moles of gas per 100 grams of generant. In addition to the higher gas yield, the resultant slag, copper metal, is easier to filter and more compatible than that produced by the doium dicyanamide fuel.

Similarly, zinc dicyanamide is better than sodium dicyanamide. Calculations show that a stoichiometrically balanced composition of zinc dicyanamide (34.14%) with strontium nitrate (65.85) produce 1.51 moles per 100 grams of generant which is higher than that produced by sodium dicanamide and strontium nitrate.

The oxidizer, which is used at a level of between about 40 and about 90 wt % is selected from ammonium, alkali metal and alkaline earth metal chlorates, perchlorates, nitrates and mixture thereof. Preferred oxidizers are nitrates.

Optionally, a portion of the oxidizer may be a transition metal oxide, such as iron oxide or cupric oxide. In addition to their oxidizing function, these oxides provide hard particles, facilitating compaction of the composition into pellets or other consolidated solid shapes. For pellitization purposes, it is preferred that between about 10 and about 50 wt % of the total oxidizer content be a transition metal oxide, particularly cupric oxide.

As is taught in U.S. Pat. No. 5,139,588, the teachings of which are incorporated herein by reference, the cations of the fuel salts and oxidizers are preferably mixtures of alkali metal cations, i.e., lithium, sodium and potassium, and alkaline earth metal cations, i.e., magnesium, calcium, strontium, barium and cerium. Upon combustion, the alkali cations form liquid slag components and the alkaline earth metal cations form solid slag components, the mixture of liquid and solid salts forming clinkers which can be readily removed from the gas stream by filtration. The ratio of solid to liquid combustion slag components may be adjusted by the ratio of alkaline earth metal cations to alkali metal cations.

Alumina, silica or mixtures thereof may be added to scavenge corrosive alkali metal oxides, such as sodium oxide and potassium oxide. Accordingly, the composition of the present invention may contain alumina and/or silica at a level of between about 0.5 and about 30 wt %. The alumina and/or silica may be in the form of particulates or as fibers, such as fibers of various silica/alumina content. Alumina is generally preferred over silica, being a more efficient scavenger.

A binder is optionally added at a level of up to 10%, preferably at least about 0.5 wt %. Suitable binder materials include but are not limited to molybdenum disulfide, graphite, polytetrafluroethylene, Viton$^R$ (a copolymer of vinylidene fluoride and hexafluoropropylene), nitrocellulose, polysaccharides, polyvinylpyrrolidones, polycarbonates, sodium silicate, calcium stearate, magnesium stearate and mixtures thereof. Preferred binder materials are molybdenum disulfide and polycarbonates.

Alkali metal and alkaline earth metal carbonates and/or oxalates may optionally be added up to about 10 wt %. These act as coolants, lowering the combustion temperature. Lower combustion temperatures minimize production of toxic gases, such as CO and $NO_x$. Generally, if used, these coolants are used at a level of at least about 1 wt %.

As noted above, the alumina and/or silica may be in the form of fibers. Fibers help to mechanically reinforce the consolidated unburned material and subsequently consolidate slag material formed by burning the composition. Graphite fibers, e.g., up to about 10 wt %, typically at least about 1 wt %, may be also be used either alone as the sole fibrous material or in conjunction with other fibrous materials.

The invention will now be described in greater detail by way of specific examples.

EXAMPLES 1–4

Gas generant compositions in accordance with the invention are formulated as follows, all amounts being in weight %:

| Component | Example 1 | 2 | 3 | 4 | Function |
|---|---|---|---|---|---|
| Sodium Dicyanamide | 31.9 | 28.66 | 23 | 19 | Fuel |
| Guanidine Nitrate | | | 10 | 15 | Co-Fuel |
| Strontium Nitrate | 68.1 | 61.34 | 57 | 51 | Oxidizer |
| Lithium Carbonate | | 5 | 10 | 15 | Coolant |
| Aluminum Oxide | | 5 | | | Slag Former |
| Thermochemical Calculations | | | | | |
| Tc* (°K.) | 2444 | 2039 | 1977 | 1831 | |
| $N_2$ (mole/100 g) | 0.51 | .77 | .82 | .81 | |
| $CO_2$ (mole/100 g) | 0.49 | .53 | .47 | .44 | |
| $H_2O$ (mole/100 g) | 0 | 0 | .25 | .34. | |

EXAMPLE 5

A generant composition in accordance with the invention are formulated as follows, all amounts being in weight %:

| Component | Example 5 | Function |
|---|---|---|
| Sodium Dicyanamide | 20.69 | Fuel |
| Guanidine Nitrate | 11.76 | Co-Fuel |
| Strontium Nitrate | 48.00 | Oxidizer |
| Lithium Carbonate | 6.87 | Coolant |
| Cupric Oxide | 12.75 | Co-oxidizer/binder |
| | 100.00% | |
| Thermochemical Calculations | | |
| Tc* (°K.) | 1947 | |
| $N_2$ (mole/100 g) | 0.77 | |
| $CO_2$ (mole/100 g) | 0.45 | |
| $H_2O$ (mole/100 g) | 0.29 | |

*Chamber Temperature

EXAMPLES 6 & 7

Examples of practical formulations of zinc and copper dicyanamide are shown in Table Ex. 6 and Ex.7 respectively. The compositions were prepared by mixing the materials in an aqueous slurry (approximately 25%), drying the composition, and screening the dried mixture. Burn rate slugs were pressed and burning rate measured at 1000 psi.

TABLE

Ex. 6
Cupric Dicyanamide Formulations
(Weight %)

| Component | Mix # 1 | 2 | 3 | 4 |
|---|---|---|---|---|
| Cupric Dicyanamide | 26.77 | 20.57 | 25.22 | 19.03 |
| Guanidine nitrate | 10 | 20 | 10 | 20 |
| Lithium carbonate | 10 | 10 | 10 | 10 |
| Strontium nitrate | 53.23 | 49.43 | 44.78 | 40.97 |
| Cupric oxide | 0 | 0 | 10 | 10 |
| Thermochemical Calculations | | | | |
| Rb (ips @ 1000 psi) | .75 | .71 | .67 | .63 |
| Moles/100 gm | 1.70 | 1.95 | 1.60 | 1.86 |

TABLE

Ex. 7
Zinc Dicyanamide Formulations
(Weight %)

| Component | Mix # 1 | 2 |
|---|---|---|
| Zinc dicyanamide | 34.14 | 24.46 |
| Strontium Nitrate | 65.86 | 60.54 |
| Lithium carbonate | 0 | 5 |
| Ammonium diliturate | 0 | 10 |
| Thermochemical Calculations | | |
| Rb (ips @ 1000 psi) | 0.65 | 0.7 |
| Miles/100 gm. | 1.51 | 1.60 |

What is claimed is:

1. A gas generant composition comprising between about 10 and about 60 wt % of a fuel, at least about 25 wt % up to 100% of which is a transition metal salt of dicyanamide or mixture of transition metal salts of dicyanamide, balance other fuel and between about 40 and about 90 wt % of an oxidizer selected from the group consisting of ammonium, alkali metal and alkanline earth metal chlorates, perchlorates, nitrates and mixtures thereof.

2. A gas generant composition according to claim 1 containing between about 0.5 and about 10 wt % of a binder.

3. A generant composition according to claim 2 wherein said binder is selected from the group consisting of molybdenum disulfide, graphite, polytetrafluoroethylene, vinyl fluoride/hexafluoropropylene copolymer, nitrocellulose, polysaccharides, polyvinylpyrrolidones, polycarbonates, sodium silicate, calcium stearate, magnesium stearate and mixtures thereof.

4. A gas generant according to claim 2 wherein said binder is selected from the group consisting of molybdenum disulfide and polycarbonates.

5. A gas generant composition according to claim 1 further containing between about 1 and about 10 wt % of a coolant selected from the group consisting of alkali metal and alkaline earth metal carbonates, oxalates and mixtures thereof.

6. A gas generant composition according to claim 1 further containing between about 1 and about 10 wt % of graphite fibers.

7. A gas generant composition according to claim 1 further containing between about 0.5 and about 30 wt % alumina and/or silica.

8. A gas generant composition according to claim 1 containing in addition to said salt(s) of dicyanamide up to about 50 wt % of a fuel selected from the group consisting of salts of bitetrazole, aminotetrazole, nitrotriazolone, triazolone, salts of nitrobarbituric acid, salts of nitroorotic acid, nitrouracil, salts of guanidine, salts of amino-substituted guanidine, and mixtures thereof.

9. A gas generant composition according to claim 1 wherein said salt of dicyanamide is cupric dicyanamide.

10. A gas generant composition according to claim 1 wherein between about 10 and about 50 wt % of said oxidizer comprises a transition metal oxide or mixtures thereof.

11. A gas generant composition according to claim 10 wherein said transition metal oxide is selected from the group consisting of ferric oxide, cupric oxide and mixtures thereof.

12. A gas generant composition according to claim 9 wherein said transition metal oxide is cupric oxide.

13. A gas generant composition comprising between about 10 and about 60 wt % of a fuel, at least about 25 wt % up to 100% of which is zinc dicyanamide, balance other fuel and between about 40 and about 90 wt % of an oxidizer selected from the group consisting of ammonium, alkali metal and alkaline earth metal chlorates, perchlorates, nitrates and mixtures thereof.

14. A gas generant composition comprising between about 10 and about 60 wt % of a fuel, at least about 25 wt % up to 100% of which is copper dicyanamide, balance other fuel and between about 40 and about 90 wt % of an oxidizer selected from the group consisting of ammonium, alkali metal and alkaline earth metal chlorates, perchlorates, nitrates and mixtures thereof.

* * * * *